US005092046A

United States Patent [19]

Collins

[11] Patent Number: 5,092,046

[45] Date of Patent: Mar. 3, 1992

[54] KNIFE AND SHEATH SYSTEM

[76] Inventor: Walter W. Collins, P.O. Box 100, North, S.C. 29112

[21] Appl. No.: 666,253

[22] Filed: Mar. 7, 1991

[51] Int. Cl.[5] ..... B26B 3/06; B26B 29/02; B26B 29/00; B65D 25/00

[52] U.S. Cl. ..... 30/162; 30/151; 224/232; 224/242

[58] Field of Search ..... 30/151, 160, 161, 162; 224/232, 242, 252, 191

[56] References Cited

U.S. PATENT DOCUMENTS

| | | | |
|---|---|---|---|
| 2,391,574 | 12/1945 | Housinger | 224/2 |
| 2,527,710 | 10/1950 | Davidson, Jr. | 224/2 |
| 2,527,711 | 10/1950 | Davidson, Jr. | 224/2 |
| 2,618,057 | 11/1952 | Gibson | 30/151 |
| 2,650,008 | 8/1953 | Morseth | 224/242 |
| 2,783,536 | 3/1957 | McQueary | 30/151 |
| 2,793,434 | 5/1957 | Wigington | 30/151 |
| 2,859,516 | 11/1958 | McQueary | 30/151 |
| 4,114,787 | 9/1978 | Rosenkaimer | 224/232 |
| 4,178,681 | 12/1979 | Hanses | 30/151 |
| 4,358,036 | 11/1982 | Maltais | 224/252 |
| 4,835,863 | 6/1989 | Salandre | 30/143 |
| 4,964,554 | 10/1990 | Collins | 224/232 |
| 5,002,213 | 3/1991 | Newton et al. | 224/242 |

*Primary Examiner*—Douglas D. Watts
*Assistant Examiner*—Paul M. Heyrana, Sr.
*Attorney, Agent, or Firm*—Michael A. Mann

[57] ABSTRACT

A sheath for a knife having a blade and a handle, the handle having a guard with a first and an opposing second portion. The sheath comprises a body with a cavity to receive the knife blade and a recess with one side forming a ramp to receive the first portion of the knife guard. The second portion of the knife guard is outside the sheath. A spring carried by the sheath engages the second portion of the guard and biases the guard so that the first portion of the guard is retained but not locked in the recess. To release the blade from the sheath, the thumb of the user presses against a lobe formed in the end of the spring to remove pressure on the second portion of the guard, allowing the first portion of the guard to be moved up the ramp side of the recess and out of the sheath, or, alternatively, the handle may be pulled with sufficient force to overcome the bias of the spring and draw the first portion of the guard up the ramp and thus the blade from the sheath. The sheath is secured to a belt with a "C" shaped pair of lips attached to the back of the sheath. An adaptor that locks into place behind one of the lips may be used for narrower belts.

24 Claims, 3 Drawing Sheets

100
102
104
106
108
110
112
114
116
118
120
122
124
126
128
130
132
134
136
150
152
156
160
166
168

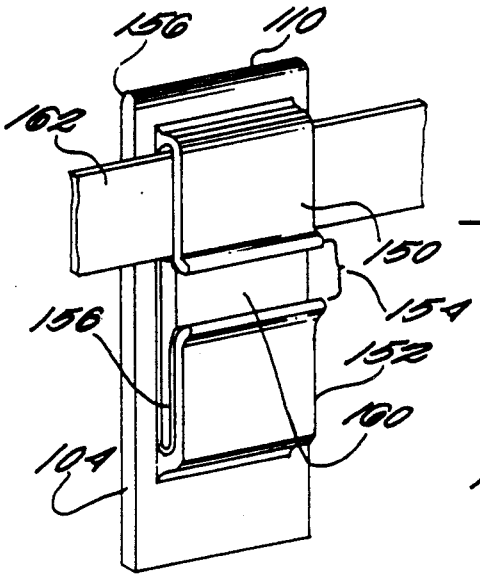
Fig. 8a
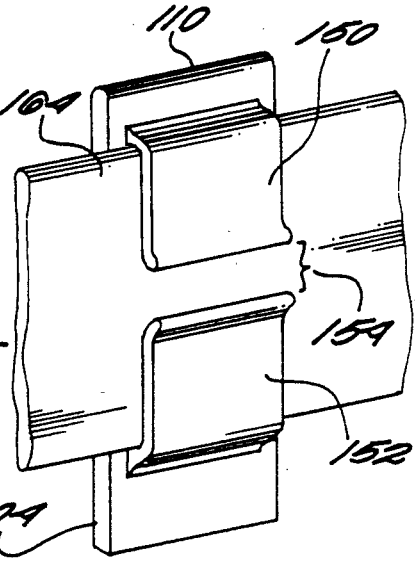
Fig. 8b
Fig. 9b
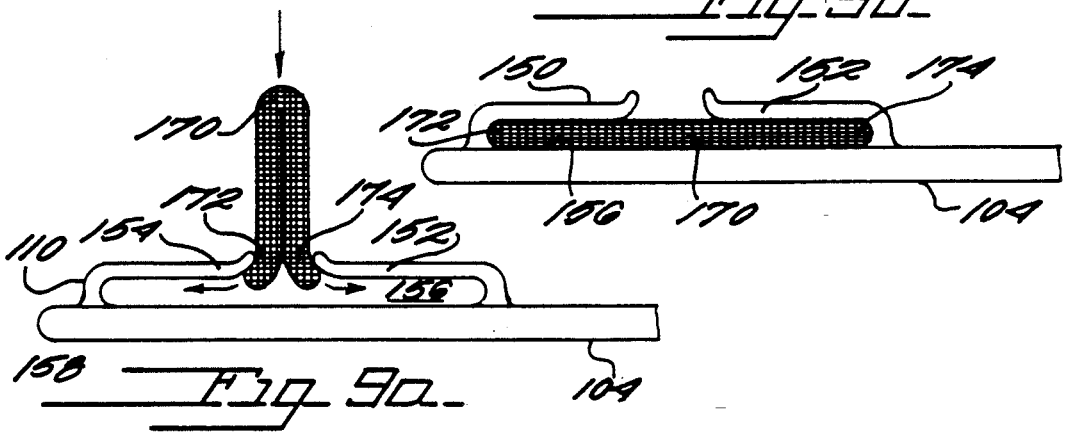
Fig. 9a

KNIFE AND SHEATH SYSTEM

BACKGROUND OF THE INVENTION

1. Field of the Invention

The present invention relates generally to knives and sheaths for knives and other sheath-carried tools. In particular, the present invention relates to sheaths with mechanisms for retaining knives.

2. Discussion of Background

Knife and sheath combinations are well known. The sheath provides a pocket or cavity for the knife blade plus a loop for attaching the sheath to a belt, leaving the handle generally exposed for gripping and is thus a safe and convenient way to carry a knife. Several sheaths are known with mechanisms to secure a knife in the sheath. See for example the knife and sheath combinations described in my U.S. Pat. No. 4,964,554. See also Salandre's U.S. Pat. No. 4,835,863 which features a spring clip for locking the knife in the sheath by engaging the hand guard; or Hanses's U.S. Pat. No. 4,178,681 which has a ramp that the knife handle rides over in order to insert it into a sheath and which then locks the knife in place. McQueary (U.S. Pat. No. 2,859,516) provides a spring with a latch element that seats in a recess in the handle of the knife. Davidson, Jr. (U.S. Pat. Nos. 2,527,710 and -711) provides a spring that engages the knife guard. See also Wigington (U.S. Pat. No. 2,793,434), Gibson (U.S. Pat. No. 2,618,057) and Housinger (U.S. Pat. No. 2,391,574).

There is always a trade-off in the design of a mechanism for locking a knife in a sheath. Too often the more secure the knife is in the sheath, the more difficult it is to remove the knife for use. Furthermore, locking mechanisms can often be complicated and involve a number of parts that must be assembled in the manufacture of the knife and sheath. On the other hand, a knife that is not secured in its sheath may be lost or cause injury. Therefore, some provision needs to be made to retain the knife in the sheath.

There is a need for a knife and sheath system that is simple to manufacture and use, that retains the knife in the sheath but readily releases it.

SUMMARY OF THE INVENTION

According to its major aspects and broadly stated, the present invention is a sheath for use with a tool, such as a knife, having an operating end and a handle. The handle of the tool has a guard near its operating end. The sheath has a body with a cavity dimensioned for receiving the operating end of the tool. In the case of a knife, the cavity receives the blade of the knife. In the body, inside the cavity, is a recess with one side that forms a short ramp. A first portion of the guard seats in this recess when the knife is sheathed. The opposing, second portion of the guard is outside the sheath, since the opening of the sheath cavity is angled so that it is not parallel to the guard. A spring carried by the body of the sheath extends from the body and engages the second portion of the guard and biases the guard so the first portion of the guard remains in the recess and the tool is thus retained in the sheath. Pressing on the spring with the thumb, or pulling on the handle of the knife with sufficient force, disengages the spring from the guard and allows the first portion of the guard to ride up the ramp of the recess. The tool is thus lifted free of the sheath.

The combination of the spring and the recess is an important feature of the present invention. The spring engages one portion of the guard outside the sheath while the opposing portion of the guard is seated within the sheath inside the recess. The knife may be released by pushing on the spring and withdrawing the knife or, because the recess has a ramped surface, the knife may also be released by simply pulling on the handle with sufficient force to overcome the bias of the spring as the first portion of the guard rides up the ramp. Likewise, the knife is seated in the sheath simply by pushing it into place, the first portion of the guard will seat into the recess urged there by the spring operating on the second portion of the guard. This feature provides a very simple but secure retaining mechanism for the knife, or other tool, used with the sheath.

The spring in itself is an important feature of the present invention. The spring in one embodiment fits into a channel formed in the body of the sheath and one end of it is held in the channel with a retaining pin. The other end of the spring extends from the channel outside the sheath and has a lobe on the end for engaging the thumb. In a preferred embodiment, the spring is molded into the channel as an integral part of the sheath.

Another feature of the present invention is a locking bar, preferably used for locking heavier, larger knives in the sheath. The locking bar rotates out of the way when use of the knife is contemplated but the knife is still retained in the sheath securely by the spring.

Still another feature of the present invention is the belting attachment. This attachment is formed of two spaced-apart lips in a generally "C" shaped arrangement on the back of the sheath so that a belt can be inserted easily. Also, for use with thinner belts, an adaptor snaps and locks into place to reduce the size of the belting attachment opening. This feature enables the sheath to be used with a variety of belts including wider, military-type webbed belts as well as belts of more conventional width. Also, the clip can be used to attach a variety of sheaths and carriers to belting.

Other features and advantages of the present invention will be apparent to those skilled in the art from a careful reading of the Detailed Description of a Preferred Embodiment presented below accompanied by the drawings.

BRIEF DESCRIPTION OF THE DRAWINGS

In the drawings,

FIGS. 8*a* and 8*b* are partial, perspective views of the belting attachment according to a preferred embodiment of the present invention showing an adaptor for sizing the belting attachment for narrower belts in position and withdrawn; and FIGS. 9*a* and 9*b* are partial, perspective views of the belting attachment opening showing a method for inserting a belt to the belting attachment.

DETAILED DESCRIPTION OF A PREFERRED EMBODIMENT

Figure 1:
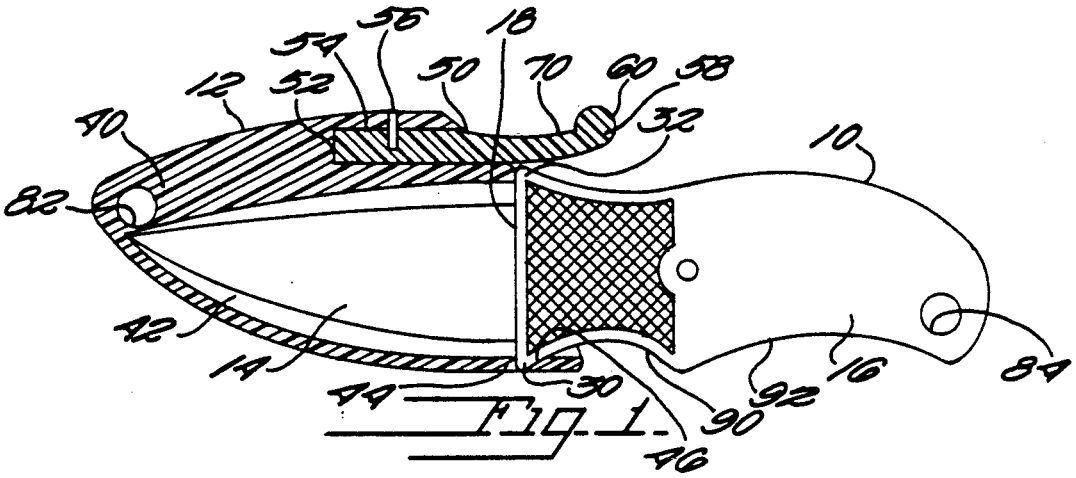
FIG. 1 is a partially cut-away side view of the knife and sheath according to a preferred embodiment of the present invention showing the knife seated in the sheath.

Referring now to FIG. 1, there is illustrated a knife 10 and sheath 12. Knife 10 could, in the alternative, be a tool of any sort that has an operating end and a handle as long as the handle has a guard. A guard is a flanged portion of a knife handle adjacent to the blade. For example, the tool could be a screw driver, an awl or an electrical probe. Knife 10 has a blade 14 and a handle 16. Handle 16 has a guard 18 with a first portion 30 and a second portion 32.

Sheath 12 has a body 40 with a cavity 42 defined therein and dimensioned to receive blade 14. Also in body 40 is a recess 44 that has a side that forms a ramp 46. Sheath 12 is formed so that first portion 30 of guard 18 is inside cavity 42 when knife 10 is seated in sheath 12 and second portion 32 is outside sheath 12.

Also formed in body of sheath 12 is a channel 50. Into channel 50 is fitted one end 52 of a spring 54, held in place, in the embodiment shown in FIG. 1, by a retainer pin 56. An opposing end 58 of spring 54 is formed into a lobe 60.

Figure 2:
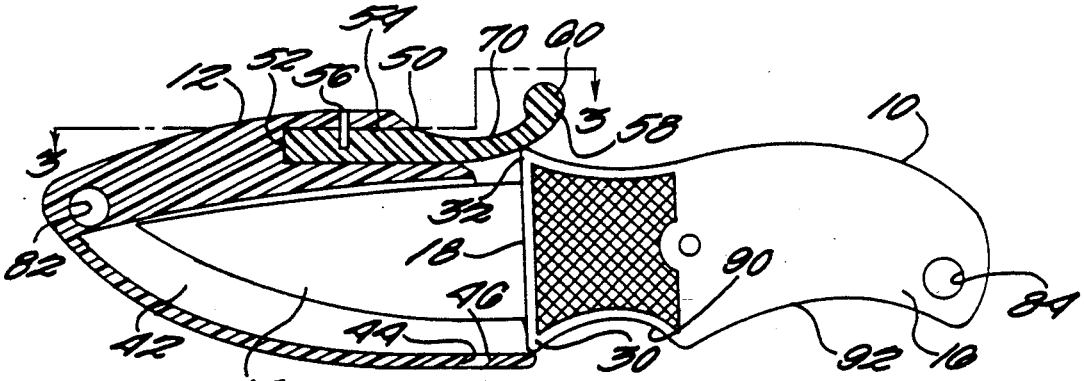
FIG. 2 is the knife and sheath of FIG. 1 with the knife partially withdrawn from the sheath.

Lobe 60 engages second portion 32 of guard 18, biasing it so that first portion 30 remains in recess 44. However, as seen in FIG. 2, when handle 16 is pulled with sufficient force to overcome spring 54 and move first portion 30 of guard 18 up ramp 46, knife 10 will be removed from sheath 12. Seating knife 10 in sheath 12 is simply a matter of pushing blade 14 into cavity 42 far enough so that first portion 30 can slide down ramp 46 urged by spring 54.

Figure 3:
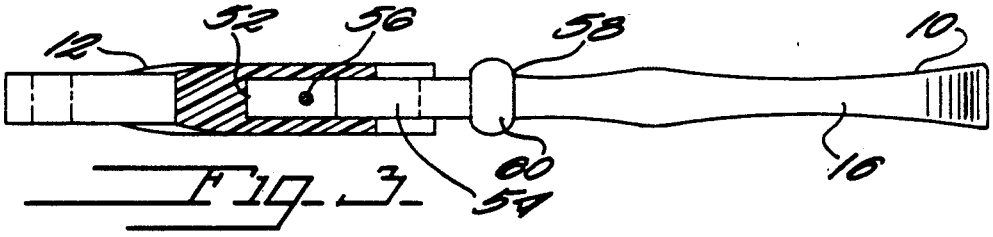
FIG. 3 is a top cross sectional view of the spring along line 3—3 of FIG. 2.
Figure 4:
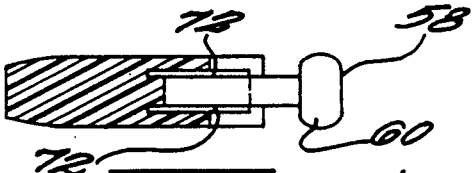
FIG. 4 is a partial, top cross sectional view of the spring according to a second embodiment of the present invention.

FIG. 3 shows a partial cross sectional view of spring 54 in channel 50. In the embodiment shown, spring 54 is a plug inserted in channel 50. FIG. 4 shows an alternative and preferred embodiment with spring 54 molded integrally with body 40. By molding body 40 including spring 54 of a material such as fiberglass filled NYLON or other hard and resilient plastic, sheath 12 then has no separate parts to be assembled. Preferably spring 54 has a thinned section 70 to increase flexibility and, in the alternative embodiment shown in FIG. 4, two cuts 72 on either side to further increase flexibility.

Knife 10 and sheath 12 may have holes 82, 84 for lanyards or clips (not shown) to attach the sheath and knife to clothing, belts and the like. Preferably also, handle 16 is contoured and has several curved portions 90, 92 for an index finger and other fingers, respectively, so that knife 10 is properly oriented in the hand. Proper orientation assures that the thumb of the user can readily engage lobe 60.

Figures 5, 6, 7:
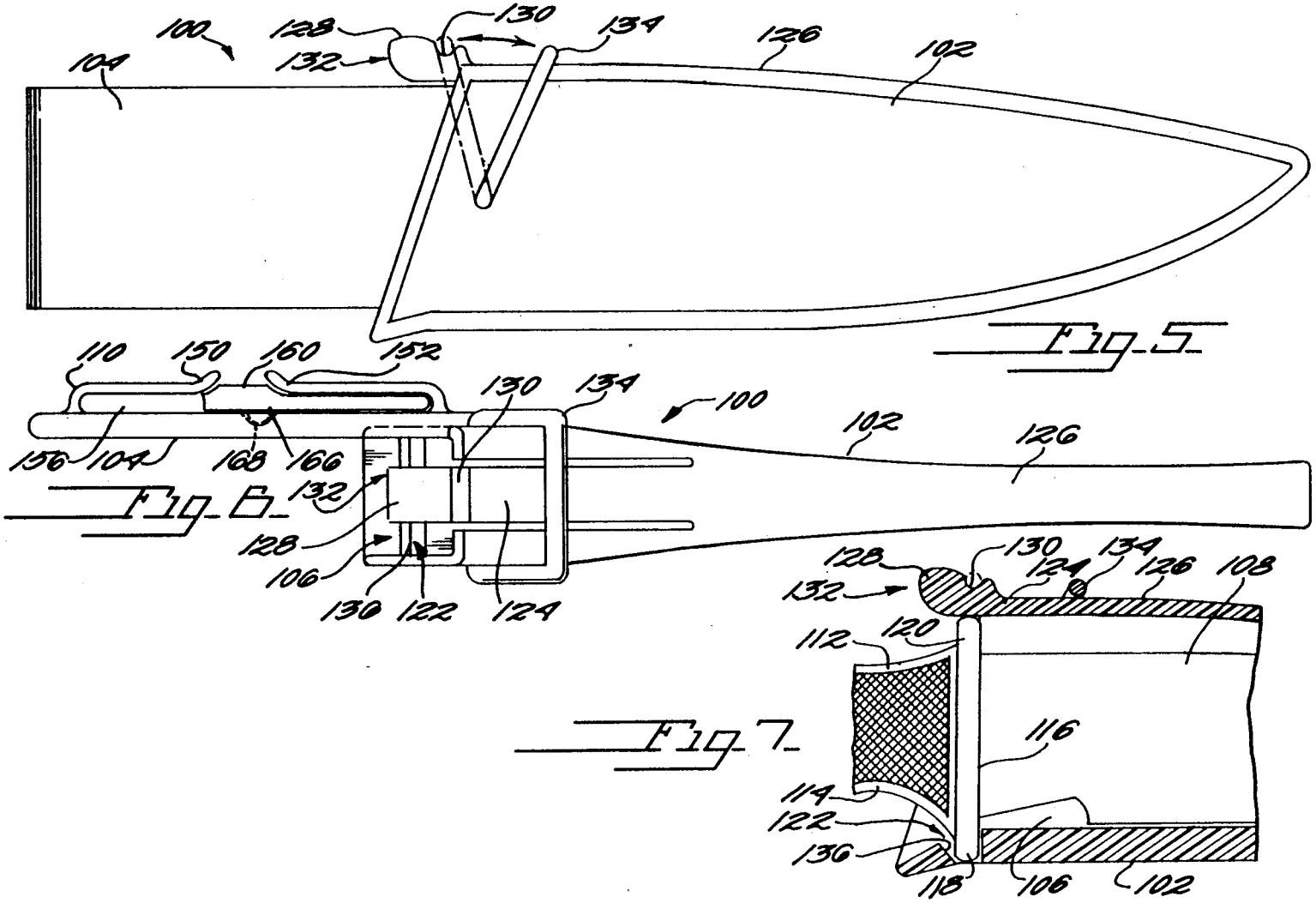
FIG. 5 is a side view of an alternative embodiment of a sheath for a larger knife according to the present invention
FIG. 6 is a top view of the alternative sheath of FIG. 5.
FIG. 7 is a partial, cross sectional view of the sheath of FIG. 5.

FIGS. 5, 6 and 7 show an alternative embodiment of the present invention. Specifically, FIGS. 5,6 and 7 illustrate a sheath 100 for a larger knife (partially shown in FIG. 7) wherein sheath 100 is to be worn on a belt or attached to a strap. FIG. 5 illustrates sheath 100 from the side; FIG. 6 illustrates sheath 100 from the top; and FIG. 7 illustrates the retaining mechanism of sheath 100.

Sheath 100 has a closed portion 102 and an open portion 104. Closed portion 102 has a cavity 106 (FIGS. 6 and 7) for receiving a knife blade 108 (FIG. 7). Open portion 104 carries a belting attachment 110 preferably integrally molded to sheath 100.

As with the previously described embodiment, the particular configuration of a knife 112 used with sheath 100 is not crucial except that knife 112 must have a handle 114 with a guard 116. Guard 116 has a first portion 118 and a second portion 120. first portion 118 seats in a recess 122 in cavity 106, held in place by a spring 124 that engages and biases second portion 120.

Spring 124 is preferably integrally molded as part of a top edge 126 of closed portion 102 of sheath 100 and has a lobe 128 with a shallow detent 130 formed at one end 132. Preferably a locking bar 134 carried by sheath 100 rotates over spring 124 and seats in detent 130 thus preventing spring 124 from being raised. As long as spring 124 cannot be raised, first portion 118 remains seated in recess 122 and knife 112 is held fast in sheath 100.

With locking bar 134 rotated away from detent 130, spring 124 will retain blade 108 in closed portion 102 of sheath 100 but knife 113 may be withdrawn by pulling handle 114 with sufficient force so that first portion 118 of guard 116 rides out of recess 122 on a ramp 136 and second portion 120 of guard 116 pushes lobe 128 of spring 124 out of the way.

FIGS. 8*a* and 8*b* and 9*a* and 9*b* illustrate belting attachment 110 carried by open portion 104 of sheath 100. Belting attachment 110 is generally shaped like an elongated, flattened "C" with two lips 150, 152 that curve behind open portion 104 toward each other but do not meet. A gap 154 is thereby defined between the ends of lips 150, 152 and a space 156 defined between open portion 104 and lips 150, 152. Lips 150 and 152 are preferably flared back and contoured to more easily receive a belt and to avoid catching on the belt as it is inserted into space 156.

Belting attachment 110 is sized for a wide belt, such as a military webbed belt. Inside space 156 is an adaptor 160 for reducing the size of space 156 so that a belt having a narrower width can be used. A narrower belt 162 is shown in FIG. 8*a*. FIG. 8*b* shows a wider belt 164 with adapter 160 removed. Adapter 160 is secured in place by a button 166 and detent 168 (best seen in FIG. 6). Button 166 is preferably carried by adaptor 160 with detent 168 formed in open portion 104.

FIGS. 9*a* and 9*b* illustrate a method for inserting a wide belt 170 into space 156. Belt 170 is first folded as shown in FIG. 9*a* and pushed into space 156. The edges 172, 174 of belt 170 separate and glide into space 156 in opposite directions until belt 170 is fully seated. Lips 150, 152 preferably are flared back slightly and contoured or beveled on the edges to guide belt 170. Adaptor 160 is preferably slightly wider than belting attachment 110 so that it can be easily grasped between the index finger and thumb and lifted, flexing lip 152, until button 166 clears detent 168 and adaptor 160 can then be lifted free of attachment 110. Adaptor 160 has a cross section just shaped to fit a first portion of space 156, leaving a second portion for belt 162, and to close gap 154, and, in addition to lock into detent 168.

Preferably the sheath of the present invention is molded of a fiberglass-filled NYLON or other durable, resilient, moldable material. The handle of the knife may also be made of the same material for uniform appearance. By molding the sheath with the spring, assembling of components of the sheath is eliminated, except for the locking bar of the alternative design.

It will be apparent to those skilled in the art that many changes and substitutions can be made to the preferred embodiment herein described without departing from the spirit and scope of the present invention which is defined by the appended claims.

What is claimed is:

1. A sheath for use with a tool, said tool having an operating end and a handle, said handle having a guard, said guard having a first portion and an opposing second portion, said sheath comprising:

a body with a cavity formed therein, said cavity dimensioned to receive said operating end of said tool;

means formed in said body for receiving said guard; and spring means carried by said body and engaging said tool for biasing said guard into said receiving means so that said tool is retained but not locked in said sheath,

2. The sheath as recited in claim 1, wherein said receiving means is formed as part of said cavity, said receiving means receiving said first portion of said guard wherein said receiving means has a recess, said recess forming a ramp up which said second portion must be pulled against said spring means to remove said operating end from said cavity.

3. The sheath as recited in claim 1, wherein said spring means engages said guard.

4. The sheath as recited in claim 1, wherein said receiving means is formed within said cavity and receives said first portion of said guard in said cavity and wherein said spring means engages said second portion of said guard outside said cavity.

5. The sheath as recited in claim 4, wherein said first portion of said guard is opposite said second portion.

6. The sheath as recited in claim 1, wherein said spring means has a lobe for engaging said thumb so that said thumb can disengage said spring means from said tool by pressing against said lobe.

7. The sheath as recited in claim 1, wherein said spring means is formed integrally with said body.

8. A sheath for use with a tool, said tool having an operating end and a handle, said handle having a guard, said guard having a first portion and an opposing second portion, said sheath comprising:

a body with a cavity formed therein, said cavity dimensioned to receive said operating end of said tool;

a recess formed within said cavity for receiving said first portion of said guard; and spring means carried by said body and engaging said first portion of said guard for urging said second portion into said recess so that said tool is retained but not locked in said sheath.

9. The sheath as recited in claim 8, wherein said recess has a side forming a ramp up which said second portion must be pulled against said spring means to remove said operating end from said cavity.

10. The sheath as recited in claim 8, wherein said body has a channel formed therein and said spring means further comprises a spring having a first end seated within said channel and a second end extending out of said channel toward said handle, said spring having a lobe formed in said second end, said spring engaging said first portion.

11. The sheath as recited in claim 8, wherein said body has a channel formed therein and said spring means further comprises a spring formed integrally with said body and having a first end located within said channel and a second end extending out of said channel toward said handle, said spring having a lobe formed in said second end, said lobe engaging said first portion.

12. The sheath as recited in claim 8, wherein said sheath is for use with a belt, said sheath further comprising:

an open portion integral with said body and extending therefrom;

a first lip and an opposing second lip, said first and said second lips attached to said open portion, said second lip spaced apart from said first lip so that said belt fits between said first and said second lips and said open portion and is secured to said open portion by said spaced apart first and second lips: and an adaptor dimensioned to fit between said first lip and said open portion.

13. The sheath as recited in claim 12, further comprising:

means for locking said adaptor between said first lip and said open portion.

14. A device, comprising:

a knife having a handle said handle having a first end and a second end, said second end having a guard, said guard having a first portion and an opposing second portion, and a blade attached to said second end; and a sheath having a body with a cavity therein dimensioned to receive said blade, a recess formed within said cavity for receiving a first portion of said guard, and spring means carried by said body and engaging said second portion of said guard for urging said first portion into said recess so that said tool is retained but not locked in said sheath.

15. The device as recited in claim 14, wherein said body has a channel formed therein and said spring means further comprises a spring having a first end seated within said channel and a second end extending out of said channel toward said handle, said spring having a lobe formed in said second end, said spring engaging said second portion.

16. The sheath as recited in claim 14, wherein said body has a channel formed therein and said spring means further comprises a spring formed integral with said body and having a first end located within said channel and a second end extending out of said channel toward said handle, said spring having a lobe formed in said second end, said spring engaging said second portion.

17. The sheath as recited in claim 15, wherein said recess has a side forming a ramp up which said first portion must be pulled to remove said operating end from said cavity.

18. The sheath as recited in claim 16, wherein said recess has a side forming a ramp up which said first portion must be pulled to remove said operating end from said cavity.

19. The sheath as recited in claim 14, wherein said sheath is for use with a belt, said sheath further comprising:

a open portion integral with said body and extending therefrom;

a first lip and an opposing second lip, said first and said second lips attached to said open portion, said second lip spaced apart from said first lip so that said belt fits between said first and said second lips and said open portion and is secured to said open portion by said spaced apart first and second lips; and an adaptor dimensioned to fit between said first lip and said open portion.

20. The sheath as recited in claim 19, further comprising:

means for locking said adaptor between said first lip and said open portion.

21. The sheath as recited in claim 14, further comprising means for locking said spring means.

22. A sheath to hang from a belt, the sheath comprising:

a closed portion with a cavity therein;

an open portion attached to said closed portion, said open portion having two opposing lips curving away and generally parallel to said open portion to define a space between said open portion and said opposing lips, each of said lips having an edge, said opposing lips defining a gap therebetween so that said belt may be inserted through said gap into said space whereby said sheath may be supported from said belt; and adaptor means for reducing the size of said space.

23. The sheath as recited in claim 22, further comprising means for securing said adaptor means to said closed portion.

24. The sheath as recited in claim 22, wherein said adaptor means further comprises an adaptor sized to fit a first portion of said space, leaving a second portion of said space for said belt, and to close said gap.

* * * * *